US005554998A

United States Patent [19]

Sherwood et al.

[11] Patent Number: 5,554,998

[45] Date of Patent: Sep. 10, 1996

[54] DEPLOYABLE SATELLITE ANTENNA FOR USE ON VEHICLES

[75] Inventors: William J. Sherwood, West Burlington; David W. Wagner, Burlington, both of Iowa

[73] Assignee: Winegard Company, Burlington, Iowa

[21] Appl. No.: 415,478

[22] Filed: Mar. 31, 1995

[51] Int. Cl.[6] ..... H01Q 1/08

[52] U.S. Cl. ..... 343/881; 343/880; 343/763

[58] Field of Search ..... 343/881, 880, 343/882, 878, 758, 757, 761, 763, 765, 766, 714, 711; H01Q 1/08, 1/12

[56] References Cited

U.S. PATENT DOCUMENTS

| | | | |
|---|---|---|---|
| 3,412,404 | 11/1968 | Bergling | 343/762 |
| 3,587,104 | 6/1971 | Budrow et al. | 343/714 |
| 3,665,477 | 5/1972 | Budrow et al. | 343/714 |
| 3,739,387 | 6/1973 | Budrow et al. | 343/714 |
| 4,309,708 | 1/1982 | Sayovitz | 343/713 |
| 4,490,726 | 12/1984 | Weir | 343/840 |
| 4,602,259 | 7/1986 | Shepard | 343/882 |
| 4,663,633 | 5/1987 | Wilson | 343/714 |
| 4,710,778 | 12/1987 | Radov | 343/882 |
| 4,771,293 | 9/1988 | Williams et al. | 343/881 |
| 4,811,026 | 3/1989 | Bissett | 343/766 |
| 4,868,578 | 9/1989 | Bruinsma et al. | 343/882 |
| 4,887,091 | 12/1989 | Yamada | 343/714 |
| 4,937,587 | 6/1990 | Tsuda | 343/765 |
| 5,337,062 | 8/1994 | Sherwood et al. | 343/711 |

FOREIGN PATENT DOCUMENTS

| | | |
|---|---|---|
| 55-53903 | 4/1980 | Japan . |
| 60-233905 | 11/1985 | Japan . |
| 60-260205 | 12/1985 | Japan . |
| 60-260207 | 12/1985 | Japan . |

OTHER PUBLICATIONS

"The Original Best Made Super–Sat RV Satellite Systems" advertisement, W.C. Laikam Co., Fresno, CA (circa 1990).

*Primary Examiner*—Hoanganh Le

*Attorney, Agent, or Firm*—Dorr, Carson, Sloan & Birney, P.C.

[57] ABSTRACT

A deployable satellite antenna system is intended primarily to be mounted to the roof of a vehicle, such as a recreational vehicle. The elevational position of the reflector is controlled by a reflector support having a lower portion pivotably attached to a base mounted to the vehicle. The elevational position of the reflector can be adjusted between a stowed position in which the reflector is stored face-up adjacent to the vehicle and a deployed position. The feed horn is supported at the distal end of a feed arm having a first segment attached to the reflector support extending outward between the base and reflector, and a second segment pivotably connected to the distal end of the first segment. The feed horn segments move between an extended position in which the feed horn is positioned to receive signals reflected from the reflector, and a folded position in which the feed horn is positioned adjacent to the reflector. A linkage extends between the base and the second segment of the feed arm causing the second segment of the feed arm to automatically pivot to its folded position when the reflector is moved to its stowed position. The linkage also allows a spring to pivot the second segment to its extended position when the reflector is moved to its deployed position. The azimuth of the antenna can be controlled by rotating the base relative to the roof of the vehicle.

15 Claims, 6 Drawing Sheets

10
20
52
50
42
44
14
30
32
22
16
12

DEPLOYABLE SATELLITE ANTENNA FOR USE ON VEHICLES

BACKGROUND OF THE INVENTION

1. Field of the Invention

The present invention relates generally to the field of satellite antennas. More specifically, the present invention discloses a deployable satellite antenna intended especially for use on a vehicle, such as a recreational vehicle.

2. Statement of the Problem

Antennas have enjoyed increasing popularity in recent years for the purpose of receiving television signals from orbiting satellites. Satellite antennas are perhaps most widely used in small towns and rural areas that are not served by cable television systems. However, a market for satellite antennas also exists for recreational vehicles, such as motor homes, campers, trailers, mobile homes, and the like, that can be moved to remote locations not serviced by conventional cable television systems. A number of special considerations come into play when adapting an antenna for use on such a vehicle. First, it should be possible to readily stow the antenna while the vehicle is traveling to minimize aerodynamic resistance and to reduce the risk of damage to the antenna, its ancillary equipment, and the vehicle resulting from aerodynamic loads and other road hazards. Second, the antenna should be able to be positioned to virtually any azimuth and elevation. With a conventional ground-based antenna, it is sometimes possible to accept a limited range of azimuths or elevations for an antenna given the known relative locations of the satellites and the antenna. In the case of an antenna mounted on a vehicle that can be moved over a wide geographic area and parked in any azimuth orientation, such restrictions are not acceptable and a full range of possible azimuth and elevation positions are necessary for the antenna. Third, the antenna system should be relatively compact while stowed and while deployed, so as not to interfere with any other objects (e.g., the air conditioning unit, vents, or luggage rack) located on the roof of a typical recreational vehicle. Finally, the system should be designed to use conventional electric motors to accurately control the motion of the mechanical linkages to position the antenna without discontinuities or singularities.

A number of deployable antennas have been invented in the past, including the following:

| Inventor | Patent No. | Issue Date |
|---|---|---|
| Sherwood et al. | 5,337,062 | Aug. 9, 1994 |
| Tsuda | 4,937,587 | June 26, 1990 |
| Yamada | 4,887,091 | Dec. 12, 1989 |
| Bruinsma et al. | 4,868,578 | Sep. 19, 1989 |
| Bisseff | 4,811,026 | Mar. 7, 1989 |
| Radov | 4,710,778 | Dec. 1, 1987 |
| Wilson | 4,663,633 | May 5, 1987 |
| Shepard | 4,602,259 | July 22, 1986 |
| | Japan 60-260207 | Dec. 23, 1985 |
| | Japan 60-260205 | Dec. 23, 1985 |
| | Japan 60-233905 | Nov. 20, 1985 |
| Weir | 4,490,726 | Dec. 25, 1984 |
| Sayovitz | 4,309,708 | Jan. 5, 1982 |
| | Japan 55-53903 | Apr. 19, 1980 |
| Budrow, et al. | 3,739,387 | June 12, 1973 |
| Budrow, et al. | 3,665,477 | May 23, 1972 |
| Budrow, et al. | 3,587,104 | June 22, 1971 |
| Bergling | 3,412,404 | Nov. 19, 1968 |
| "The Original Best Made Super-Sat RV Satellite Systems" advertisement, W. C. Laikam Co. Inc., Fresno, CA (circa 1990). | | |

The advertisement by W. C. Laikam Co. Inc. shows a satellite antenna system that can be mounted to the roof of a recreational vehicle. The elevation control mechanism includes a gear and linkage assembly driven by the elevation motor that automatically moves the feed arm to a stowed position when the dish is lowered and moves the feed arm to an extended position when the dish is deployed. This arrangement requires an elongated opening through the dish to accommodate the feed arm and one of the linkages. In addition, a coil spring extends from the feed arm and attaches to the face of the dish. Openings and attachments to the dish may be acceptable in older satellite antenna systems having a large dish (e.g., three to five feet in diameter). However, such irregularities in the reflective surface of the dish would significantly degrade performance in newer, smaller satellite antennas.

Sherwood et al. disclose a deployable satellite antenna for use on vehicles. The reflector is stowed in a face-down position with the feed horn protected beneath the reflector.

Tsuda discloses a low profile scanning antenna having an arcuately shaped track. A carriage supporting the antenna dish moves along the inside of the arcuate track.

Yamada discloses a receiving antenna for vehicles having a horizontally rotatable base plate with a main reflector tiltably attached to the edge of the base plate. A sub-reflector is mounted at the end of an arm extending from the base plate.

Bruinsma et al. disclose a portable reflector antenna assembly having a triangular base frame employing three beam members that are joined together at their ends with hinge-type knuckles that are slidably positioned on three legs. The frame can be adjusted on the legs for both height and leveling by virtue of the slidable movement of each of the knuckles along the legs. When the desired position is reached, the knuckles are clamped to the legs by means of lever-cam actuated draw bolts. The reflector is supported along its rim by pivotal supports and clamps. The bottom edge of the reflector is slidably adjustable in azimuth along the front beam member of the frame. The top edge of the reflector is supported for slidable elevation adjustment along a shaft 42 that extends upward from the rear leg 18.

Bissett discloses a mobile satellite receiving antenna especially for use on recreational vehicles. A generally cylindrical collar extends upward from the vehicle roof. A parabolic reflector is hinged along an edge to a horizontal turntable within the collar so that the reflector may be rotated to a concave downward position to serve as a weather cover over the collar and also to provide smooth aerodynamic conditions during transport.

Radov discloses a modular earth station for satellite communications having a frame adapted to be installed in an inclined roof. A concave antenna is adjustably mounted to the frame and covered by a rigid canopy.

Wilson discloses a vehicle-mounted satellite antenna system having a base plate mounted on the vehicle roof, a support member rotatably secured to the base plate to permit rotation about a vertical axis, and a parabolic reflector pivotably secured to the support member. A one-piece feed arm 56 is pivotally secured to one end of the parabolic reflector. When the antenna is deployed, the feed arm is automatically pivoted to a position in which the feed horn is coincident with the focus of the reflector. When the antenna is returned to its rest position, the feed arm is automatically pivoted so that the feed horn is retained within the confines of the interior surface of the reflector. Here again, the linkage 68 used to raise the feed arm 56 requires an opening 66 through the face of the dish.

Shepard discloses a polar mount for a parabolic satellite-tracking antenna.

Japanese Patent Nos. 60-260207 and 60-260205 disclose a vehicle-mounted antenna that can be stowed with the dish in a face-down position against the roof of the vehicle.

Japanese Patent No. 60-233905 discloses an antenna having a feed arm that permits the feed horn to be stowed in a position adjacent to the surface of the dish.

Weir discloses a collapsible rooftop parabolic antenna. The antenna has a horizontal pivot that provides axial displacement if axial wind forces on the antenna exceed a predetermined limit. This limits the torque transmitted to the roof on which the antenna is mounted to a reasonably low level.

Sayovitz discloses a foldable disk antenna supported on a framework resting on the bed of a truck or trailer. Folding legs on the framework can be extended to contact the ground to support the antenna.

Japanese Patent No. 55-53903 discloses a satellite antenna with a tracking system that allows the antenna to be stowed.

The patents to Budrow et al. disclose several embodiments of a TV antenna suitable for mounting on the roof of a recreational vehicle. The direction of the antenna can be controlled from the vehicle interior. In addition, the antenna dipoles can be folded to a closed position when the vehicle is transported.

Bergling discloses a dish reflector having a stowed position.

3. Solution to the Problem

None of the prior art references uncovered in the search show a deployable antenna system having the structure of the present invention. In particular, the linkage mechanism used in the present invention to automatically fold the feed arm assembly as the antenna is stowed is neither taught nor suggested by the prior art. The present system is especially suited for use with smaller reflectors due to the fact that the face of the reflector is left intact, without requiring openings or attachments. The present system is also simple and reliable, and has fewer exposed components.

SUMMARY OF THE INVENTION

This invention provides a deployable satellite antenna system intended primarily to be mounted to the roof of a vehicle, such as a recreational vehicle. The elevational position of the reflector is controlled by a reflector support having a lower portion pivotably attached to a base mounted to the vehicle. The elevational position of the reflector can be adjusted between a stowed position in which the reflector is stored face-up adjacent to the vehicle and a deployed position. The feed horn is supported at the distal end of a feed arm having a first segment attached to the reflector support extending outward between the base and reflector, and a second segment pivotably connected to the distal end of the first segment. The feed horn segments move between an extended position in which the feed horn is positioned to receive electrical signals reflected from the reflector, and a folded position in which the feed horn is positioned adjacent to the reflector. A linkage extends between the base and the second segment of the feed arm causing the second segment of the feed arm to automatically pivot to its folded position when the reflector is moved to its stowed position. The linkage also allows a spring to pivot the second segment to its extended position when the reflector is moved to its deployed position. The azimuth of the antenna can be controlled by rotating the base relative to the roof of the vehicle.

A primary object of the present invention is to provide a deployable antenna that can be readily mounted to the roof of a vehicle, such as a typical recreational vehicle.

Another object of the present invention is to provide a deployable antenna that can be easily stowed and deployed.

Yet another object of the present invention is to provide a deployable antenna that is relatively compact when stowed and when deployed, so as not to interfere with other objects (e.g., the air conditioning unit, vents, or luggage rack) located on the roof of a recreational vehicle.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which.

DETAILED DESCRIPTION OF THE INVENTION

Figure 1:
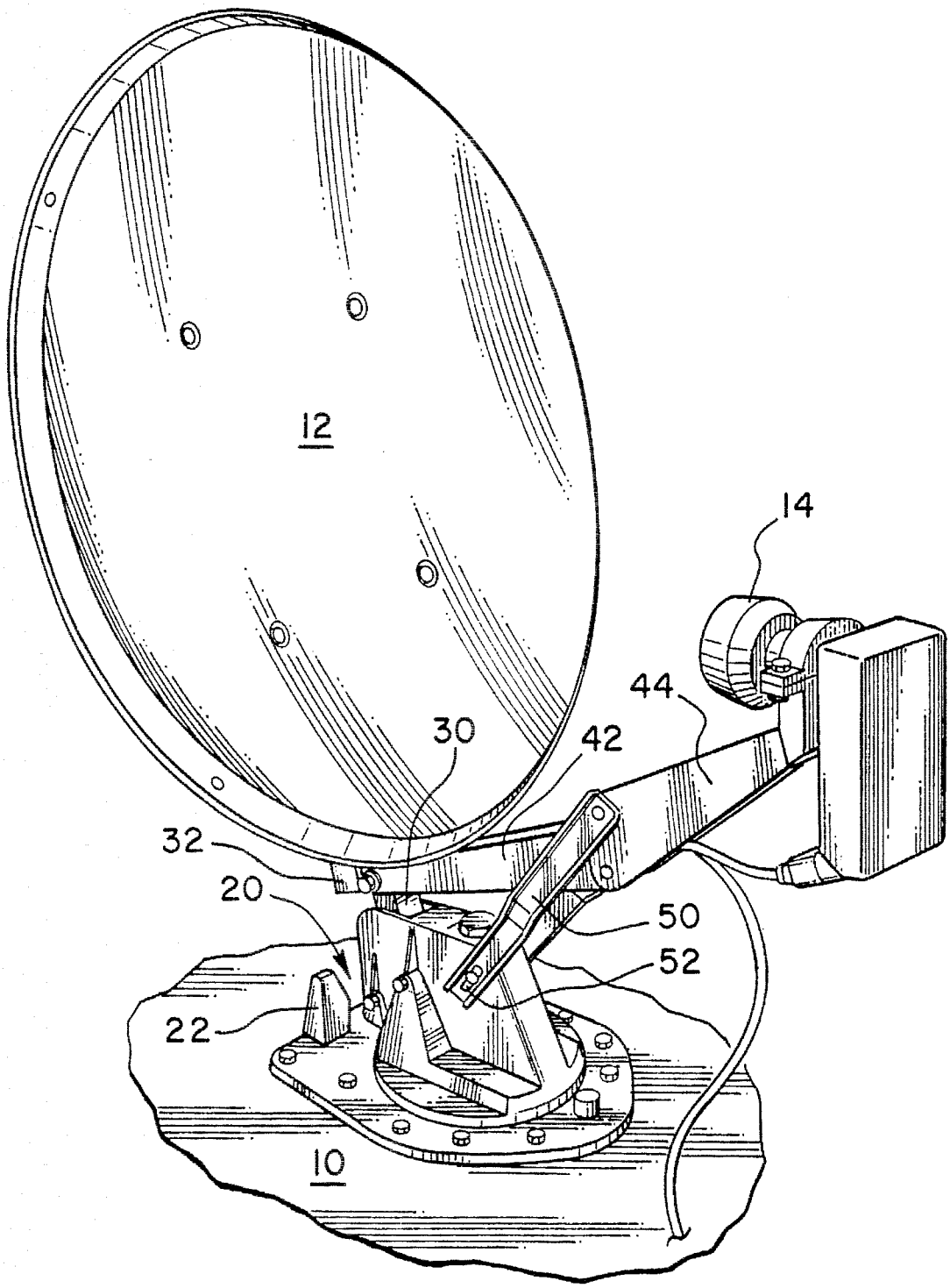
FIG. 1 is a front perspective view of the entire satellite antenna assembly.

As shown in FIG. 1, the antenna system includes a reflector 12 having a substantially parabolic or concave spherical face to reflect and focus radio signals on a feed horn 14 when the antenna system is in its deployed state, as depicted in FIG. 1. A corresponding rear perspective view is provided in FIG. 2. The entire antenna system is attached by a base assembly 20 to a support surface 10, such as the roof of a recreational vehicle or trailer.

The reflector 12 is supported by the upper, distal portion of the reflector support 30. The lower portion of the reflector support 30 is pivotably attached to the base 20. This structure effectively permits elevational rotation of the reflector 12 about the lower end of the reflector support 30 and the base 20.

Figures 3, 6, 7:
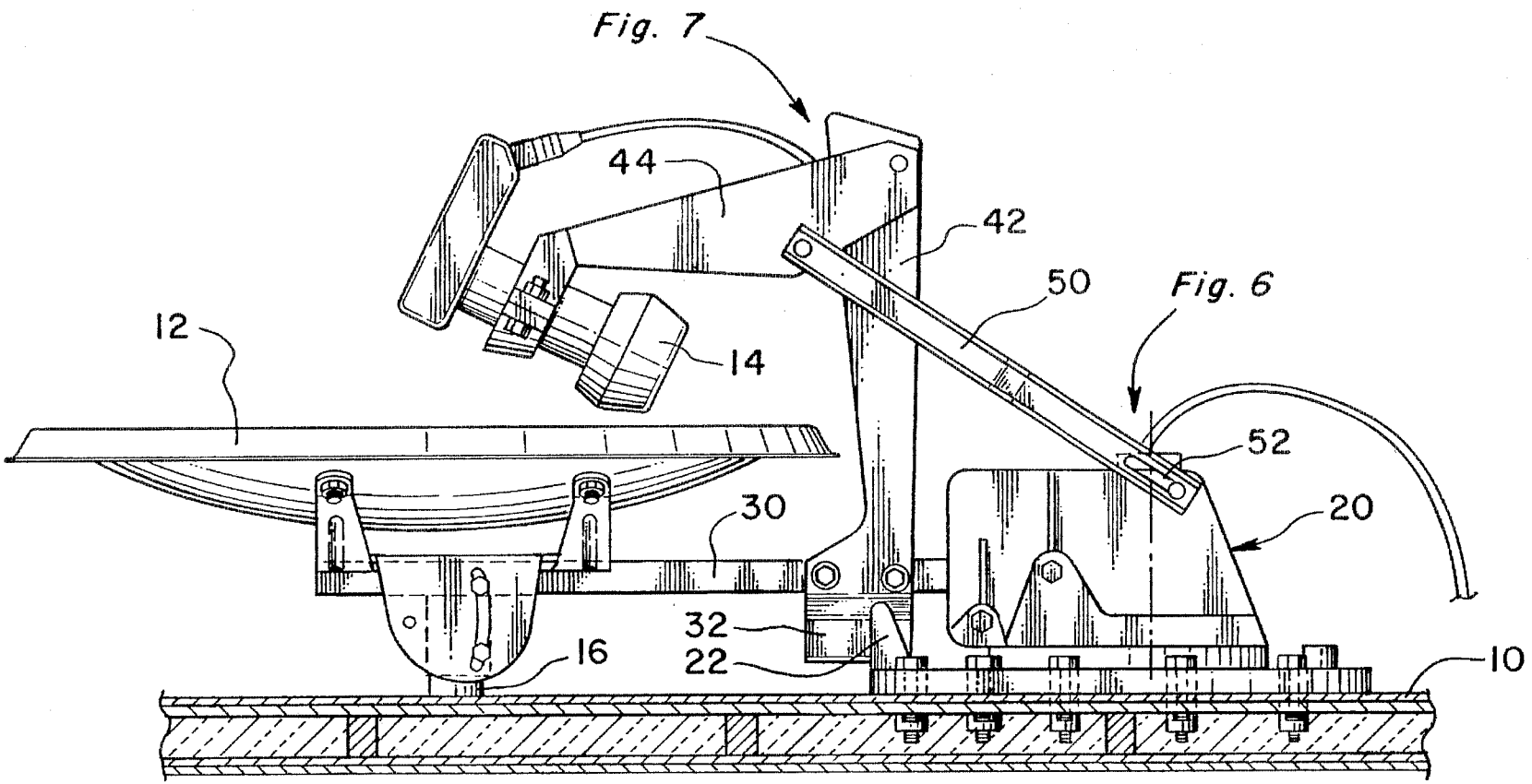
FIG. 3 is a side view of the antenna in its stowed position. The roof of the vehicle is shown in cross-section.
FIG. 6 is a side cross-sectional view of the base showing the elevation gear and worm gear used to raise and lower the antenna.
FIG. 7 is a side cross-sectional view providing additional detail of the connection between the segments of the feed arm assembly.

The feed horn 14 is supported at the distal end of a hinged feed arm assembly 42, 44. Most specifically, the first segment 42 of the feed arm is attached to the reflector support 30 at a point between the base 20 and the lower edge of the reflector 12. In the preferred embodiment, the first segment 42 of the feed arm extends forward in a direction substantially perpendicular to reflector support 30. The second segment 44 of the feed arm is pivotably attached to the distal end of the first segment 42 and supports the feed horn 14. FIG. 7 is a side cross-sectional view providing additional detail of the hinge joint between the segments 42 and 44 of the feed arm assembly. These segments 42 and 44 form an elbow joint that enables the feed arm assembly fold as the antenna is stowed and extend as the antenna is deployed. A spring 45 exerts a moment about the elbow joint that tends to open or extend the segments 42 and 44.

The relative positions of the segments 42 and 44 are also controlled by the linkage 50 extending between the base assembly 20 and the second segment 44 of the feed arm. This linkage 50 is typically a rigid member having a lower end pivotably connected the base 20 and an upper end pivotably connected to the second member 44 of the feed arm at a point between the feed horn 14 and the elbow joint. In the preferred embodiment, the lower end of the linkage 50 is connected to the anterior portion of the base 20 at a predetermined distance from the connection between the reflector support 30 and the posterior portion of the base 20, as best illustrated in FIGS. 1 and 3. The distance between these two pivot points is calculated to result in the appropriate range of motion for the linkage 50 as described below.

Figure 5:
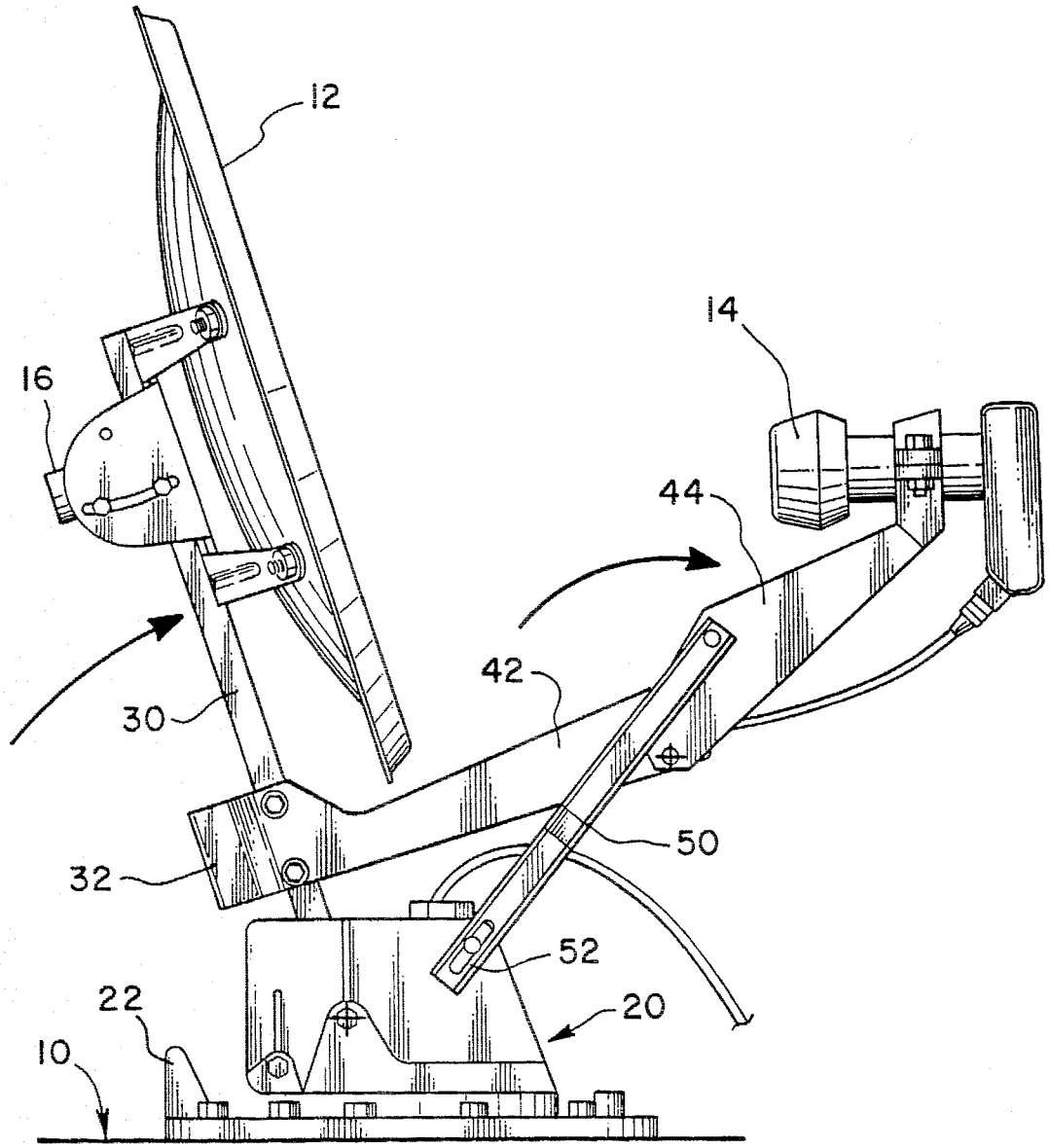
FIG. 5 is a side view of the antenna in its fully deployed position.
Figure 6:
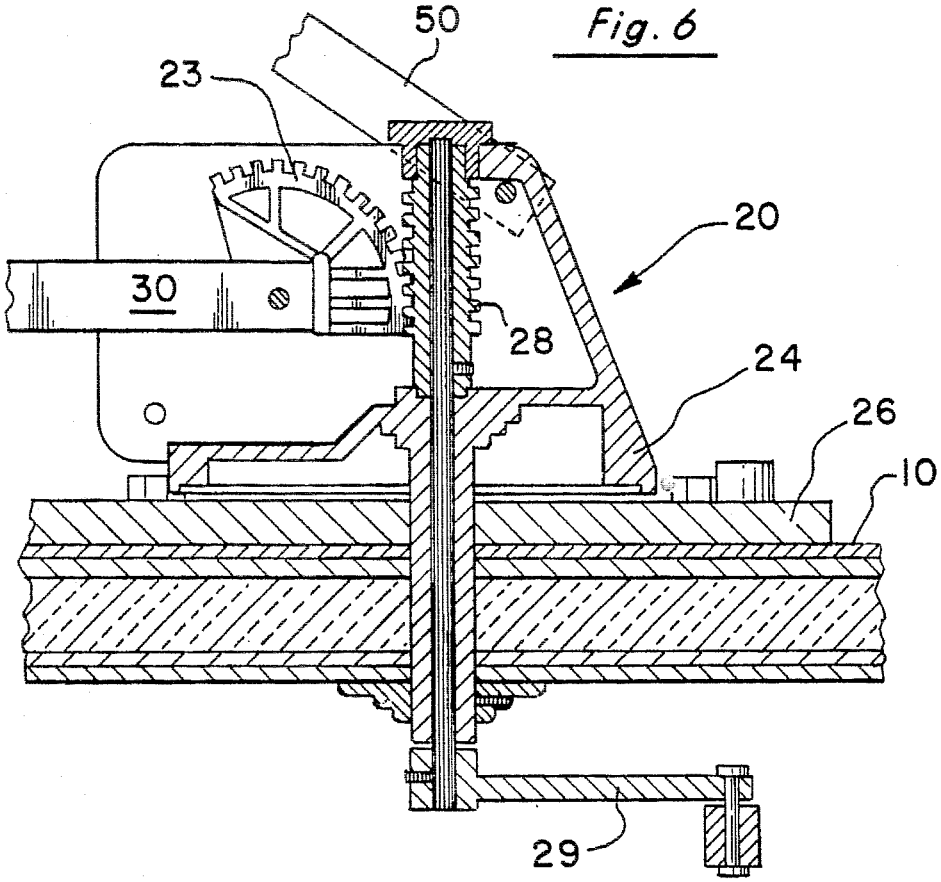
Figure 7:
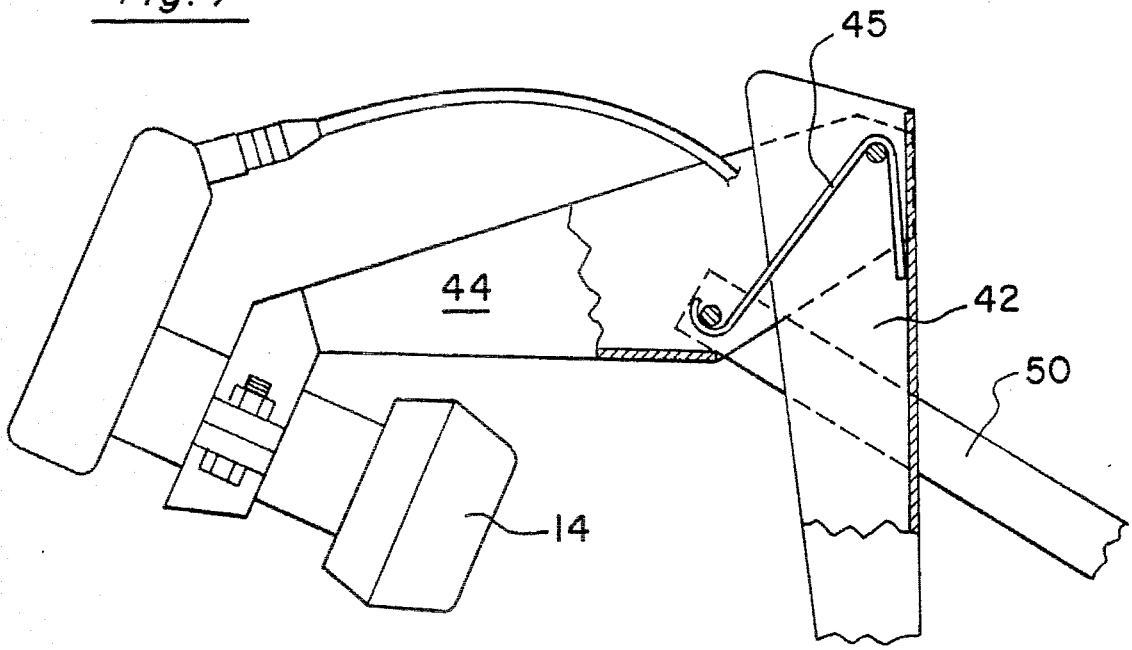

The linkage 50 causes the second segment 44 of the feed arm to pivot to a folded position relative to the first segment 42 when the reflector 12 is moved to its stowed position, and also allows the spring 45 to pivot the second segment 44 to an extended position relative to the first segment 42 when the reflector 12 is moved to its deployed position. When stowed, the distal end of the second segment 44 moves the feed horn 14 to a position adjacent to the face of the reflector 12, as shown in FIG. 3. When the antenna is deployed as shown in FIG. 5, the spring 45 moves the distal end of the second segment 44 carrying the feed horn 14 to a predetermined position further away from the reflector 12 to receive signals reflected by the reflector 12. The elbow joint prevents over-extension of the second segment 44 relative to the first segment 42, and also helps to ensure accurate positioning of the feed horn 14 during operation of the antenna. The linkage 50 includes a slot 52 at its base end to accommodate the variation in the distance between the point of attachment to the second segment 44 and the point of attachment to the base 20 over the range of motion of the linkage 50.

Figure 2:
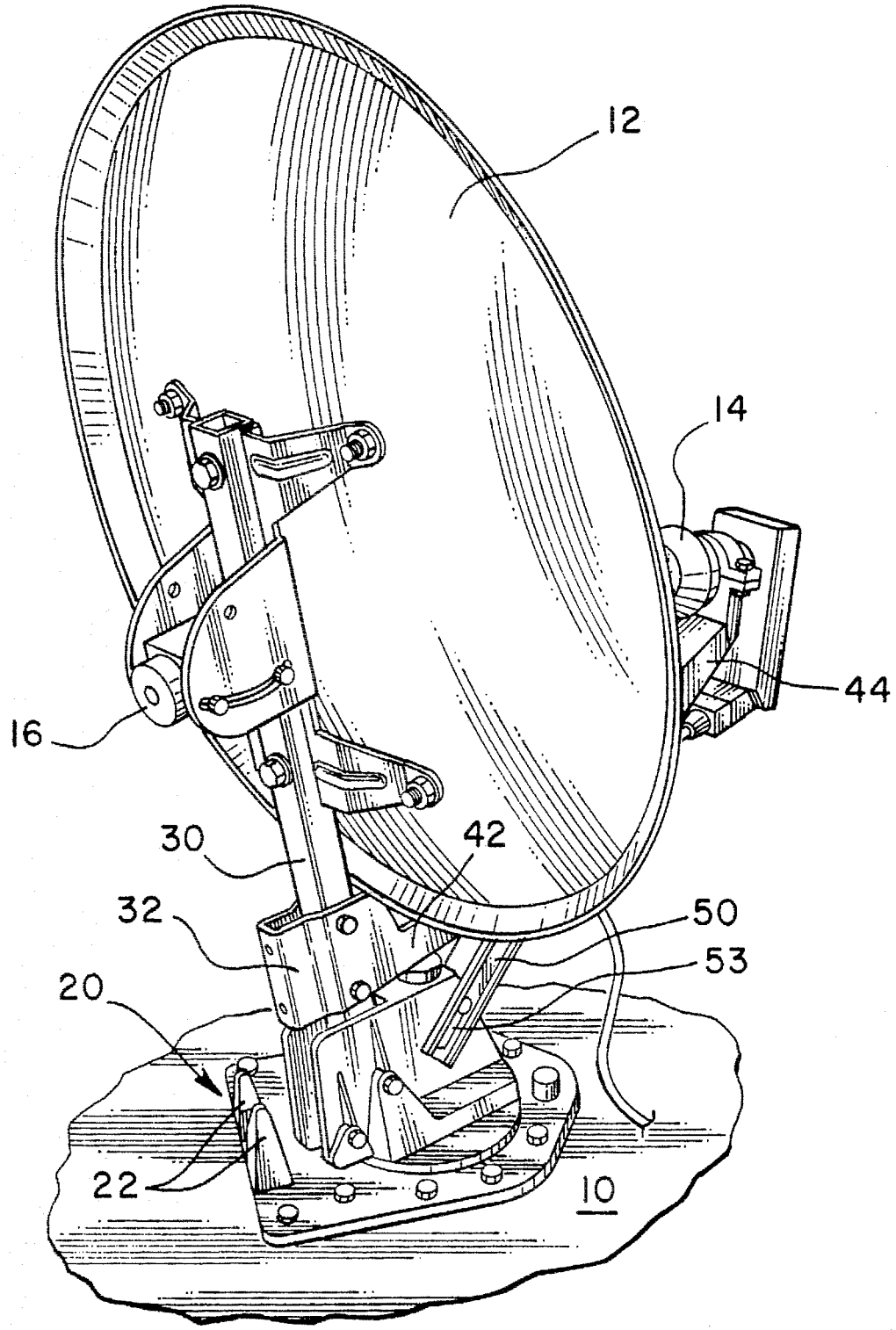
FIG. 2 is a corresponding rear perspective view of the entire assembly.

FIG. 6 is a side cross-sectional view of the base assembly 20. A large elevation gear 23 is secured to the reflector support 30. A manual crank mechanism 29 mounted beneath the base 20 is used to drive a worm gear 28, which in turn drives the elevation gear 23 to raise and lower the antenna 12. Alternatively, an electric motor could be employed to rotate the worm gear 28. The base 20 also provides a rotating platform for the remainder of the system about a predetermined azimuth axis when the reflector is raised from its stowed position. In a typical installation, this azimuth axis extends vertically upward from the roof of the vehicle 10 through the center of the base 20. The base gear housing 24 rotates about the azimuth axis relative to the bases plate 26, as illustrated in FIG. 6. The azimuth orientation of the base gear housing 24 is adjusted by means of either an electric motor or a hand-crank mechanism. In the preferred embodiment, the reflector support assembly includes a travel bracket 32 attached to the rear of the reflector support member 30 as shown in FIG. 2. While the reflector is stowed as depicted in FIG. 3, the travel bracket is held between two ears 22 extending upward from the base plate 26 (shown in FIG. 6) to prevent azimuth rotation. A resilient bumper 16 attached to the rear of the reflector assembly comes into contact with the support surface 10 to define the fully stowed position for the antenna.

Figure 4:
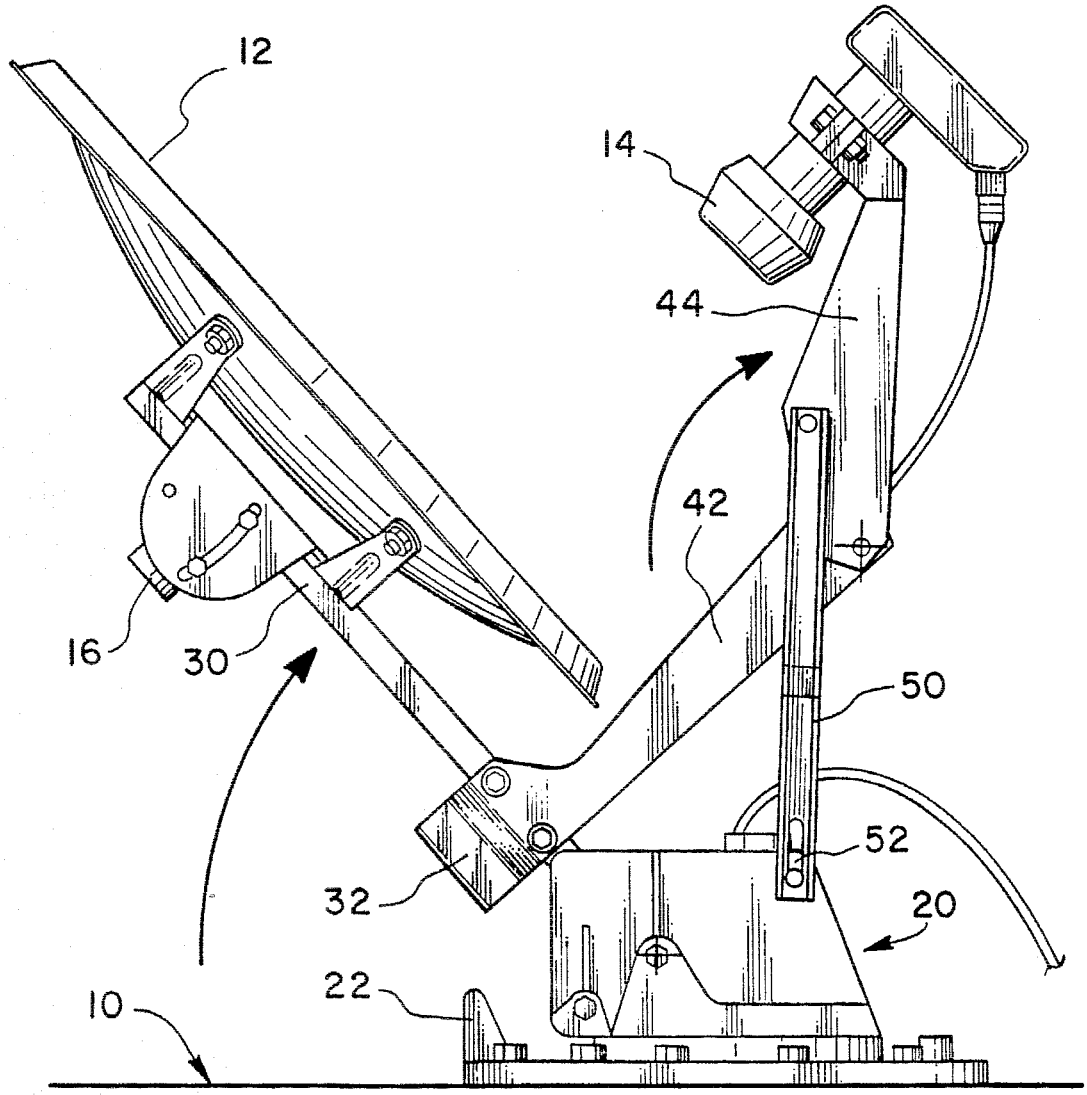
FIG. 4 is a corresponding side view of the antenna in a partially deployed position.

FIGS. 3 through 5 illustrate the antenna moving through three stages in the deployment process. FIG. 3 is a side view of the antenna in its stowed position with the roof of the vehicle 10 shown in cross-section. FIG. 4 is a corresponding side view of the antenna in a partially deployed state. FIG. 5 shows the fully deployed antenna. In the stowed position shown in FIG. 3, the reflector 12 is stowed face-up. The linkage 50 pulls the feed arm assembly 42, 44 into a folded position and thereby draws the feed horn 14 next to the face of the reflector 12. FIG. 4 shows an intermediate position in the deployment process in which the segments 42 and 44 of the feed arm have gradually straightened as the reflector 12 rotates upward. However, the feed horn 14 is not yet moved to its fully deployed position. In FIG. 5, the reflector 12 and feed horn 14 have reached their fully deployed positions. The spring 45 has pivoted the second segment 44 of the feed arm to its fully extended position. This moves the feed horn 14 into the proper position relative to the reflector 12 for operation. The procedure shown in FIGS. 3 through 5 is simply reversed to stow the antenna.

It should be noted that the first and second members 42, 44 of the feed arm assembly and the linkage 50 do not require slots or openings through the surface of reflector 12. Furthermore, none of these components require attachments to the reflector. The face of the reflector 12 is left completely undisturbed. This feature is important to maintain signal strength due to the small size of the latest satellite antennas, which are often only about 18 inches in diameter.

The above disclosure sets forth a number of embodiments of the present invention. Other arrangements or embodiments, not precisely set forth, could be practiced under the teachings of the present invention and as set forth in the following claims.

We claim:

1. A deployable antenna system to be mounted on a support surface, said antenna system comprising:

a base mounted to said support surface;

a reflector having a face;

a feed horn for receiving electrical signals reflected by said reflector;

a reflector support having a lower portion pivotably attached to said base and an upper portion attached to said reflector;

elevation control means for adjustably controlling the elevational position of said reflector support and said reflector between a stowed position in which said reflector is stored face-up adjacent to said support surface with said feed horn above said reflector, and a deployed position;

a feed arm having:

(a) a first segment attached to said reflector support extending between said base and said reflector without passing through said reflector, said first segment also having a distal end; and (b) a second segment supporting said feed horn, pivotably attached to said distal end of said first segment without passing through said reflector; and a linkage extending between said base and said second segment of said feed arm without passing through said reflector, said linkage causing said second segment of said feed arm to pivot to a folded position relative to said first segment when said reflector is moved to said stowed position, and allowing said second segment to pivot to an extended position relative to said first segment when said reflector is moved to said deployed position.

2. The antenna system of claim 1 wherein said support surface comprises the roof of a vehicle.

3. The antenna system of claim 1 wherein said linkage comprises a substantially rigid member having a first end pivotably connected to said base and a second end pivotably connected to said second segment of said feed arm.

4. The antenna system of claim 1 further comprising a spring for pivoting said second segment of said feed arm to said extended position relative to said first segment of said feed arm when said reflector is moved to said deployed position.

5. The antenna system of claim 1 further comprising azimuth control means for adjustably controlling rotation of said antenna system about an azimuth axis.

6. The antenna system of claim 1 wherein said elevation control means comprises:

an elevation gear attached to said reflector support;

a worm gear driving said elevation gear; and means for rotating said worm gear.

7. A deployable antenna system to be mounted on a vehicle or the like, said antenna system comprising:

a base mounted to said vehicle;

a reflector having a face;

a feed horn for receiving electrical signals reflected by said reflector;

a reflector support having a lower portion pivotably attached to said base and an upper portion attached to said reflector;

elevation control means for adjustably controlling the elevational position of said reflector support and said reflector between a stowed position in which said reflector is stored face-up adjacent to said vehicle with said feed horn above said reflector, and a deployed position;

a feed arm having:

(a) a first segment attached to said reflector support extending between said base and said reflector without passing through said reflector, said first segment also having a distal end; and (b) a second segment supporting said feed horn, said second segment being pivotably connected to said distal end of said first segment to move between an extended position wherein said feed horn is positioned to receive signals reflected from said reflector, and a folded position wherein said feed horn is positioned adjacent to said reflector without passing through said reflector; and a linkage extending between said base and said second segment of said feed arm without passing through said reflector, said linkage causing said second segment of said feed arm to pivot to said folded position when said reflector is moved to said stowed position, and allowing said second segment to pivot to said extended position when said reflector is moved to said deployed position.

8. The antenna system of claim 7 further comprising azimuth control means for adjustably controlling rotation of said antenna system about an azimuth axis.

9. The antenna system of claim 7 wherein said linkage comprises a substantially rigid member having a first end pivotably connected to said base and a second end pivotably connected to said second segment of said feed arm.

10. The antenna system of claim 7 wherein said elevation control means comprises:

an elevation gear attached to said reflector support;

a worm gear driving said elevation gear; and means for rotating said worm gear.

11. The antenna system of claim 7 further comprising a spring for pivoting said second segment of said feed arm to said extended position relative to said first segment of said feed arm when said reflector is moved to said deployed position.

12. A deployable antenna system mounted on the roof of a recreational vehicle, said antenna system comprising:

a base mounted to said vehicle and being rotatable about an azimuth axis, said base having a posterior portion and an anterior portion;

a reflector having a face;

a feed horn for receiving electrical signals reflected by said reflector;

a reflector support having a lower portion pivotably attached to said posterior portion of said base and an upper portion attached to said reflector;

elevation control means for adjustably controlling the elevational position of said reflector support and said reflector between a stowed position in which said reflector is stored face-up adjacent to said vehicle adjacent to said support surface with said feed horn above said reflector, and a deployed position;

a feed arm having:

(a) a first segment attached to said reflector support extending between said base and said reflector without passing through said reflector, said first segment also having a distal end; and (b) a second segment having a distal end supporting said feed horn and a proximal end pivotably connected to said distal end of said first segment by means of an elbow joint allowing said second segment to move between an extended position wherein said feed horn is positioned to receive signals reflected from said reflector, and a folded position wherein said feed horn is positioned adjacent to said reflector without passing through said reflector; and a linkage having a lower end pivotably connected to said anterior portion of said base and an upper portion pivotably connected at a point between said distal and proximal ends of said second segment of said feed arm without passing through said reflector, said linkage pulling said second segment of said feed arm to pivot to said folded position when said reflector is moved to said stowed position, and allowing said second segment to pivot to said extended position when said reflector is moved to said deployed position.

13. The antenna system of claim 12 further comprising azimuth control means for adjustably controlling rotation of said base about said azimuth axis.

14. The antenna system of claim 12 further comprising a spring for pivoting said second segment of said feed arm to said extended position relative to said first segment of said feed arm when said reflector is moved to said deployed position.

15. The antenna system of claim 12 wherein said elevation control means comprises:

an elevation gear attached to said reflector support;

a worm gear driving said elevation gear; and means for rotating said worm gear.

* * * * *